United States Patent [19]

La Torre et al.

[11] 4,450,451

[45] May 22, 1984

[54] GIMBAL ASSEMBLY FOR MONOPULSE RADAR ANTENNA

[75] Inventors: Richard R. La Torre, Bedford; Robert A. Phaneuf, Chelmsford, both of Mass.

[73] Assignee: Raytheon Company, Lexington, Mass.

[21] Appl. No.: 356,697

[22] Filed: Mar. 3, 1982

[51] Int. Cl.[3] ..... H01Q 3/02; H01Q 1/28

[52] U.S. Cl. ..... 343/765; 343/705; 244/3.19

[58] Field of Search ..... 343/759, 761–763, 343/765, 766, 16 M, 705, 711–713; 244/3.14, 3.19, 3.16

[56] References Cited

U.S. PATENT DOCUMENTS

| | | | |
|---|---|---|---|
| 2,667,578 | 1/1954 | Barnett et al. | 343/761 |
| 2,963,973 | 12/1960 | Estey | 244/3.16 |
| 3,084,342 | 4/1963 | Fuller et al. | 343/756 |
| 3,756,538 | 9/1973 | McLean | 244/3.16 |
| 3,898,668 | 8/1975 | Evans et al. | 343/759 |
| 3,982,714 | 9/1976 | Kuhn | 244/3.16 |
| 4,009,393 | 2/1977 | Ashley, Jr. et al. | 244/3.16 |
| 4,039,246 | 8/1977 | Voigt | 244/3.16 |
| 4,070,678 | 1/1978 | Smedes | 343/754 |
| 4,142,695 | 3/1979 | Remmell et al. | 244/3.14 |

*Primary Examiner*—Eli Lieberman
*Assistant Examiner*—Michael C. Wimer
*Attorney, Agent, or Firm*—Philip J. McFarland; Joseph D. Pannone

[57] ABSTRACT

A gimbal assembly for a monopulse antenna gyroscopically stabilized on a moving vehicle is shown to comprise a tripartite bearing having a fixed spherical inner section, an annular central section, connected through a helical spring to the moving vehicle, mounted on the spherical inner section and an annular outermost section rotatably mounted on the central section to form a gyroscopic mass that may be precessed.

3 Claims, 1 Drawing Figure

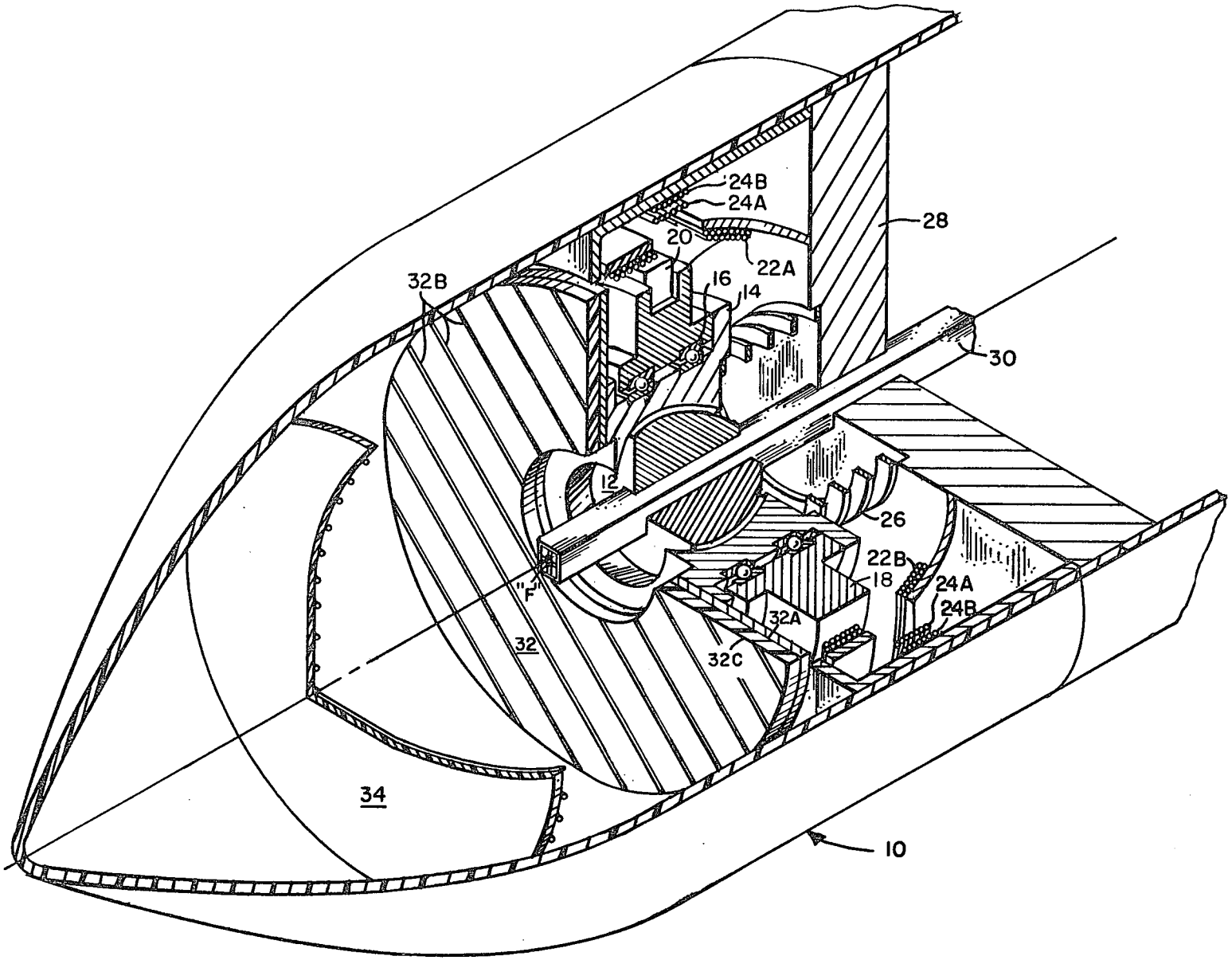
10
12
14
16
18
20
22A
22B
24A
24B
26
28
30
32
32A
32B
32C
34
F

GIMBAL ASSEMBLY FOR MONOPULSE RADAR ANTENNA

BACKGROUND OF THE INVENTION

This invention pertains generally to antenna systems, and, particularly, to an antenna system mounted on gimbals and disposed within a cannon-launched projectile.

In the development of anti-armor weapon systems, a so-called "all weather guidance system" is required that will be effective under adverse conditions, such as when targets are obscured by smoke or when countermeasures are employed. Such a guidance system must also be sufficiently compact to permit mounting within a conventional artillery shell. To meet such requirements and others not mentioned, active monopulse radar seekers have been developed.

It is known, as shown in the copending U.S. patent application, Ser. No. 356,700 filed Mar. 3, 1982 (which application is assigned to the same assignee as this application), that an infrared sensor may be gimballed in a cannon-launched projectile in such a manner as to withstand the shock of firing. Briefly, such a degree of ruggedness is achieved by gyroscopically stabilizing a mirror in such a sensor on a ball bearing or a spherical air bearing. Unfortunately, however, such a mirror may not be replaced by a corresponding antenna element in a monopulse radar because monopulse operation would not then be possible.

SUMMARY OF THE INVENTION

With this background of the invention in mind, it is therefore a primary object of this invention to provide gimballing for a monopulse radar antenna to be used in a cannon-launched projectile.

It is another object of this invention to provide an antenna for a monopulse radar whereby a beam may be scanned through an angle greater than the antenna gimbal angle.

These and other objects of the invention are attained generally by providing a gyroscopically stabilized antenna supported on a spherical bearing, such antenna being restrained from rotation along with a gyroscopic mass also supported on such bearing. Mechanical decoupling of the antenna and gyroscopic mass is achieved by the combination of a second bearing located between a support for the antenna and the gyroscopic mass and a helical coil spring connected to such support to counteract any drag between the support for the antenna and the gyroscopic mass so that the antenna may be gimballed without spinning.

BRIEF DESCRIPTION OF THE DRAWING

For a more complete understanding of this invention, reference is now made to the following description of a preferred embodiment illustrated in the accompanying drawing wherein:

The single FIGURE is an isometric view, quarter-sectioned and somewhat simplified, of a stabilized antenna according to this invention.

DESCRIPTION OF THE PREFERRED EMBODIMENT

Referring now to the FIGURE, a gyroscopically controlled platform (not numbered) is shown to include a gimbal (not numbered) made up of three abutting sections whereby the boresight angle of an antenna assembly (not numbered) may be gyroscopically stabilized and such antenna may be oriented (with respect to the longitudinal axis of a projectile 10) without spinning. The innermost section 12 of the gimbal (not numbered) is a spherical bearing, supported in any convenient manner so as to be centered at a point on the longitudinal axis of the projectile 10. The central section 14 of the gimbal is a first annular member mounted as shown on the spherical bearing and shaped to receive the inner race (not numbered) of a ball bearing 16. The outermost section 18 of the gimbal is a second annular member shaped as shown to receive the outer race of the ball bearing 16 and to support a pair of permanent magnets such as that designated 20. Precession coils and stator coils such as those designated 22A, 24A, 22B, 24B are affixed, in any convenient manner, about the periphery of the gimbal, as shown. Leads (not shown) from each of the coils provide: (a) the requisite rotating magnetic field to cause the outermost section 18 to rotate so as to become a gyroscopic mass; and (b) a magnetic field interacting with the permanent magnet 20 to orient the outermost section 18 with respect to the longitudinal axis of the projectile 10. The central section 14 then is similarly oriented about the spherical bearing 12. However, the rotational movement of the outermost section 18 is almost completely decoupled from the central section 14 by reason of operation of the ball bearing 16.

The drag on the central section 14 due to friction in the ball bearing 16 (which obviously would cause some rotation of the central section 14) is overcome by restraining means, here a helical spring 26, disposed as shown between a bulkhead 28 and the central section 14. The ends of the helical spring 26 are attached in any convenient manner to the bulkhead 28 and the central section 14. It will now be apparent that, although the helical spring 26 appears to be a rigid body preventing any rotational movement of the central section 14 induced by drag in the ball bearing 16, the coils (not numbered) of such spring will yield when the central section 14 is subjected to a force in any plane orthogonal to the plane of rotation of the outermost section 18. To put it another way, the helical spring 26 allows gimballing of the central section 14 (and the outermost section 18) about the spherical bearing 12 and completes decoupling of the rotational movement of the outermost section 18 from the central section 14.

The antenna assembly here is substantially similar to the arrangement shown in U.S. Pat. No. 4,070,678, issued Jan. 24, 1978 and assigned to the same assignee as the present invention, without the spherical electromagnet lens incorporated in that arrangement. Thus, a waveguide 30 (here divided by septa (not numbered) to form a monopulse feed with the "H" plane horizontal in each division) is mounted in any convenient manner so that the center of one end is located at a point marked "F" on the longitudinal axis of the projectile 10. The second end of the waveguide 30 is led to a radar transmitter/receiver (not shown). A planar polarization-twisting reflector 32 is mounted in any convenient manner on the central section 14. A polarized paraboloid 34 is affixed to the projectile 10 in any convenient manner so that the focal point of such paraboloid is coincident with the point F.

As described in detail in the patent cited above, the planar polarization twisting reflector 32 is a conventional "quarter-wave plate" made up of a metallic base member 32A and a plurality of parallel wires 32B oriented at an angle of 45° to the "H" plane and spaced (by means of a dielectric spacer 32C) from the metallic base member 32A by one-quarter wavelength of the radio frequency energy at the operating frequency. The polarized paraboloid 34 is made up of an appropriately shaped dielectric base (not numbered) supporting a plurality of parallel wires (not numbered) oriented parallel to the "H" plane. Preferably such wires are printed on such base in any convenient manner.

Again, for reasons described in the cited patent, the waveguide 30 and the pluralities of wires in the polarization-twisting reflector 32 and the polarized paraboloid 34 are oriented with respect to each other in such a manner that: (a) for radio frequency energy emanating from the waveguide 30 during transmission or for radio frequency energy reflected from the polarization-twisting reflector 32 during reception, the polarized paraboloid 34 is, for all practical purposes, opaque; and (b), for radio frequency energy reflected from the polarization-twisting reflector 32 reflected during transmission, or for radio frequency energy reflected from any target (not shown) outside the projectile 10, the polarized paraboloid 34 is, for all practical purposes, transparent. It follows, then, that gimballing of the central section 14 causes the attached polarization-twisting reflector 32 to be similarly oriented. The result then is that the centerline of the radar beam (not shown) may be oriented with respect to the longitudinal centerline (not shown) of the projectile 10. To put it another way, the boresight line of the described antenna assembly may be changed with respect to the longitudinal axis of the projectile 10, such boresight line being gyroscopically stabilized without detracting from proper monopulse operation by rotation of the polarization-twisting reflector 32. In passing, it will be noted that the thickness of the dielectric spacer 32C preferably is determined so that the path length of radio frequency energy passing through such spacer is at the nominal quarter-wavelength when the boresight angle (the angle between the longitudinal axis of the projectile 10 and the centerline of the radar beam) is equal to one-half the maximum desired scan angle.

Having described a preferred embodiment of the invention, it will now be apparent to one of skill in the art that many modifications may be made without departing from the disclosed concept. It is felt, therefore, that this invention should not be restricted to its disclosed embodiment, but rather should be limited only by the scope of the appended claims.

What is claimed is:

1. A tripartite gimbal assembly for a gyroscopically stabilized monopulse antenna installed in a moving vehicle having a longitudinal axis, such assembly comprising:

(a) an innermost section affixed to the moving vehicle, such section including a spherical bearing centered at a point on the longitudinal axis of such vehicle;

(b) a central section, generally annular in shape, having an inner surface matching the spherical bearing;

(c) an outermost section rotatably mounted on the central section;

(d) means for rotating the outermost section to gyroscopically stabilize such section and the central section;

(e) means for precessing the outermost section thereby to gimbal the central section on the innermost section;

(f) means, connected between the moving vehicle and the central section, for preventing rotation of the central section and for allowing such section to gimbal on the innermost section; and (g) means for mounting a reflector for the monopulse antenna on the central section.

2. The tripartite gimbal assembly as in claim 1 wherein the means connected between the moving vehicle and the central section is a helical spring.

3. The tripartite gimbal assembly as in claim 2 wherein a ball bearing is mounted between the central section and the outermost section to effect the rotational mounting of the latter on the former.

* * * * *